US009079640B1

(12) United States Patent
Ryan, III

(10) Patent No.: US 9,079,640 B1
(45) Date of Patent: Jul. 14, 2015

(54) SYSTEM AND PROCESS FOR DIRECTING ACTIONS OF A HELMSMAN OF A LIFEBOAT

(71) Applicant: John Ryan, III, Houston, TX (US)

(72) Inventor: John Ryan, III, Houston, TX (US)

(73) Assignee: ALEXANDER/RYAN MARINE & SAFETY CO., Houston, TX (US)

( * ) Notice: Subject to any disclaimer, the term of this patent is extended or adjusted under 35 U.S.C. 154(b) by 15 days.

(21) Appl. No.: 14/170,212

(22) Filed: Jan. 31, 2014

(51) Int. Cl.

| | |
|---|---|
| ***B63B 23/00*** | (2006.01) |
| ***B63B 23/58*** | (2006.01) |
| ***B63C 9/02*** | (2006.01) |
| ***B63B 23/70*** | (2006.01) |

(52) U.S. Cl.
CPC ..... *B63B 23/58* (2013.01); *B63B 23/70* (2013.01); *B63C 9/02* (2013.01)

(58) Field of Classification Search
USPC ..... 114/368, 377
IPC ..... B63B 23/58
See application file for complete search history.

(56) References Cited

U.S. PATENT DOCUMENTS

| | | | | |
|---|---|---|---|---|
| 4,281,867 | A | 8/1981 | Kariagin | |
| 4,841,901 | A | 6/1989 | McGluw et al. | |
| 5,078,073 | A | 1/1992 | Bettz et al. | |
| 5,205,600 | A | 4/1993 | Moore | |
| 5,408,221 | A * | 4/1995 | Carsella et al. | 340/604 |
| 5,619,951 | A | 4/1997 | Constantinis | |
| 6,152,065 | A | 11/2000 | Gronstrand | |
| 6,904,864 | B2 | 6/2005 | Re et al. | |
| 6,920,839 | B2 | 7/2005 | Pelley | |
| 8,156,886 | B2 | 4/2012 | Velcic | |
| 2005/0112963 | A1 * | 5/2005 | Lavorata et al. | 441/35 |
| 2010/0283575 | A1 * | 11/2010 | Tubb et al. | 340/5.1 |

* cited by examiner

*Primary Examiner* — Stephen Avila
(74) *Attorney, Agent, or Firm* — Egbert Law Offices, PLLC

(57) ABSTRACT

A system for directing actions of a helmsman of a lifeboat has a lifeboat with a connector at opposite ends thereof, a shackle sensor cooperative with each of the connectors so as to sense whether the shackle is engaged or released from the connector, and a display positioned within the lifeboat that is cooperative with the shackle sensor so as to provide the helmsman with a visual indication of the engagement or release of the shackle from the connector. Each of the connectors has a hook pivotally mounted thereto. A hook sensor is cooperative at the hook so as to sense whether the hook is in the open position or the closed position. Water sensors are mounted to the lifeboat so as to sense whether the lifeboat has contacted a surface of the body of water. The various sensors are cooperative with the display so as to provide the helmsman with a sequence of operations during the use of the lifeboat.

18 Claims, 11 Drawing Sheets

SYSTEM AND PROCESS FOR DIRECTING ACTIONS OF A HELMSMAN OF A LIFEBOAT

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to lifeboats. More particular, the present invention relates to systems and processes for the deployment and/or recapture of a lifeboat. Additionally, the present invention relates to sensors as utilized within the various components of a lifeboat so as to provide guided instruction to the helmsman as to the proper procedures for deploying the lifeboat.

2. Description of Related Art Including Information Disclosed Under 37 CFR 1.97 and 37 CFR 1.98.

Lifeboats are in common use on offshore vessels, including ships and oil and gas platforms. Typically, a lifeboat will be supported from a twin fall davit on the marine vessel or oil drilling platform. In emergency conditions, it is known for personnel on the offshore vessel to climb into the lifeboat. The helmsman of the lifeboat will then actuate the necessary controls so as to cause the davits to lower the lifeboat to the surface of the water.

During maintenance and cleaning, it is quite common for personnel to utilize maintenance pendant pins so as to engage the lifeboat to structures on the offshore vessel. As such, during these procedures, the support of the lifeboat is provided both by the maintenance pendant pins and by the fall prevention devices. Unfortunately, on occasion, personnel fail to remove the maintenance pendant pin or pins. As such, during emergency conditions, there are situations whereby release of the lifeboat is not possible because of the engagement of the maintenance pendant pin. As such, although the fall prevention devices or connectors have been released from their shackles, the boat may still be supported by the maintenance pendant pin. Under such circumstances, complicated procedures will be necessary so as to raise the lifeboat so that the maintenance pendant pin can be released so as to allow for the lowering of the lifeboat. In other circumstances, a single maintenance pendant pin will remain in place. As such, the lifeboat will move toward a generally vertical orientation. Once again, complicated procedures are necessary so as to correct for these problems.

In emergency situations, a trained person will be employed as a helmsman for the lifeboat. The helmsman goes through a variety of training procedures so that the helmsman is effectively able to carry out the necessary procedures on the lifeboat during the emergency situation. Unfortunately, even with a great deal of training, the helmsman often forgets the proper procedures to be carried out. As such, the lifeboat may be improperly deployed or placed into a further dangerous situation.

In other circumstances, the emergency condition may be such that the trained helmsman is not available for the operation of the lifeboat. In emergency circumstances, personnel may be injured, including the helmsman. As such, it would be desirable for relatively untrained person to take command of the lifeboat and carry out procedures necessary to deploy the lifeboat. Untrained personnel will find great difficulty in understanding the proper procedures to be carried out under such emergency conditions. Once again, injuries could occur as a result of the improper deployment of a lifeboat from the marine vessel.

During the deployment of a lifeboat, it is very important that the lifeboat be positioned in the water before the connectors of the lifeboat are released from the shackles of the davit lines. If the release should occur too early, the lifeboat could fall to the water. This could cause injury to persons within the lifeboat. In other circumstances, if a single connector is released from the shackle of the davit line, then the lifeboat may have a tendency to go into a vertical orientation and be improperly deployed. As such, a need has developed so as to assure that the connectors of the lifeboat are not released prematurely from the shackles of the davit lines.

During the recapture of the lifeboat following drills or emergency deployments, it is important that the hook of the connector be in a position whereby the hook can receive the shackle of the davit line therein. Typically, personnel on the lifeboat will forget that it is necessary to reset the hook of the connector such that the shackle can be received therein. As such, remedial procedures would be necessary so as to carry out this type of engagement. It is important for the helmsman of a lifeboat to realize the various procedures that must be carried out so as to recapture the lifeboat and restore the lifeboat to its proper position on the marine vessel.

A twin fall davit lifeboat or a totally enclosed motor-propelled survival craft is used to evacuate personnel from offshore drilling platforms or marine vessels. This type of lifeboat system has release mechanisms that disengage the lifeboat from the davit lines when the craft reaches or is just above the water. Regulations state that the release mechanisms on a lifeboat must be operable with the full weight of the lifeboat on the davit lines. Although this regulation has been drafted to ensure the lifeboat will be positively released when the release mechanisms are operated, there has been and continues to be, isolated cases of improper settings of the release mechanisms, including cases of premature releases at some undesirable distance above the water.

Generally, the lifeboat release mechanisms of the prior art have interlocking parts including hooks to which are attached the ropes supporting the lifeboat. These hooks are allowed to pivot in such a way so as to release the ropes from the lifeboat upon a rotation thereof from their holding positions. Each hook is held in its holding position by a catch member. In some of these prior art devices, being guide engagement of the hook with the catch member is very small such that when the catch member is moved even by a slight amount, the hook is released and pivots on itself, thereby releasing the lifeboat line unexpectedly. As such, it is important to be able to sense when the hook and/or the catch is in its proper position so as to avoid the accidental release of the lifeboat line.

In the past, the helmsman is often provided with an instruction manual within the lifeboat. Under emergency circumstances, the helmsman may not follow the procedures in the manual. In other circumstances, procedures may be skipped in view of the urgency of the situation. Whenever procedures are skipped, there is a possibility of accidents and improper deployment. As such, it is important to be able to assure that the helmsman is following the proper procedures during the deployment of the lifeboat.

In the past, various patents have issued relating to the deployment of lifeboats. For example, U.S. Pat. No. 4,281,867, issued on Aug. 4, 1981 to N. Carriagin, describes a disengaging apparatus for a lifeboat. The disengaging apparatus includes a hook pivotally located below its hooking point between a pair of plates. The disengaging apparatus has a counterbalanced cam locking structure wherein the force applied to the hook by the weight of the lifeboat causes positive engagement with a cam surface. When the force applied to the surface falls below a predetermined level, a counterweight rotates the cam structure away from the hook and allows for the rotation of the hook to open. The counterweight is further used to positively pull the hook to the open position after a given amount of travel.

U.S. Pat. No. 4,841,901, issued on Jun. 27, 1989 to McGluw et al., discloses a support structure for lifeboats which is weight-operated. The support structure includes a plurality of support members, each or some of which may be telescopic which are pivotally interconnected adjacent their associated interconnected ends. Each successive upper one of a pair of such members is pivotal relative to the next adjacent lowermost member about a substantially horizontal axis. The pivoting is controlled by a control mechanism which is operated from a fluid pressure source produced by the weight of the elements upon each other. The construction is such that a lifeboat may be supported in either a lower or an elevated position on a large ship and the individual support members may be articulated relative to each other so as to pivot the boat outwardly away from the vessel or ship in any manner which is desired.

U.S. Pat. No. 5,078,073, issued on Jan. 7, 1992 to Bettz et al., teaches a method and apparatus for a lifeboat safety strop. This apparatus provides additional safety during the launching of survival craft from a ship or a platform to which it is attached. The safety strop includes a connecting line which is attached at its upper end to a means for lowering a launch pendant and a lifeboat. The lifeboat is equipped with an on-load release means for launching it. The lower end of the connecting line is attached to a release means, such as a shackle or a pelican hook. The connecting line has a longer length than the launch dependent, so that no load is carried by the connecting line unless the lifeboat is prematurely released from the launch dependent.

U.S. Pat. No. 5,205,600, issued on Apr. 27, 1993 to R. Moore, provides an automatic quick-release coupling/decoupling mechanism for deploying and retrieving a lifeboat. The mechanism includes a frame, a hook member pivotally attached to the frame, a block member pivotally attached to the frame, a lock pin slidably disposed in a slot in the frame, and a trip member pivotally attached to the frame. The hook member has first and second hook portions adapted to engage the lock pin and a lift ring attached to the tethered object, respectively, and an attached counterweight disposed eccentric to the pivot point.

U.S. Pat. No. 5,619,951, issued on Apr. 15, 1997 the D. A. Constantinis, shows a system for launching a lifeboat from davits on an offshore drilling platform. The system includes a submerged buoyancy device tethered to the bow of the lifeboat by a cable which passes between the buoyancy device and the lifeboat. The cable is retained by a release mechanism attached to the platform just above the waterline and extends upward from a guide fairlead attach to the sea bed, between the latter and the lifeboat.

U.S. Pat. No. 6,904,864, issued on Jun. 14, 2005 to Re et al., provides a controlled lifeboat deployer so as to control the descent of a seafaring vessel into the water. The control system controls the descent speed of the vessel to minimize the possibility of setback after splashdown. As such, it increases the probability of a safe and orderly launch.

U.S. Pat. No. 6,920,839, issued on Jul. 26, 2005 to D. M. Pelley, discloses a lifeboat release mechanism that has a hook movably mounted thereto. The hook has a concave surface on its lower end. A latch block having a convex surface thereon is also movably mounted therein. In a holding mode, the convex surface of the latch block is laid against the concave surface of the hook. In a release mode, the convex surface is below the concave surface.

U.S. Pat. No. 6,152,065, issued on Nov. 28, 2000 to J. Gronstand, teaches an apparatus for launching and recovery of lifeboats. The boat is normally stored on a dock. The dock is provided with buoyant elements fixed to a frame. The boat is supported in a cradle within the frame. On launching and recovery of the boat, the dock is lowered to a floating position on the surface of the water. In order to fix the boat to the dock, a locking device is provided. The dock is given rolling and pitching periods which coincide as closely as possible with those of the boat. The dock and the boat will thereby behave in approximately the same manner in the water so as to make it relatively simple to run the boat into the dock even in a very heavy sea.

U.S. Pat. No. 8,156,886, issued on Apr. 17, 2012 to K. Velcic, shows a device or apparatus for launching a lifeboat from a structure that is at least partially surrounded by water. The device includes at least one launch ramp and a means to effect translational displacement of the launch ramp when the device has been mounted on the structure in order to enable the position of the launch ramp to be changed before launching the boat into the water.

It is an object of the present invention to provide a system and process for directing the actions of a helmsman of a lifeboat which provides ordered instructions to the helmsman.

It is another object of the system and process of the present invention to provide sensors which detect the completion and/or status of the various steps associated with the launch of a lifeboat.

It is still another object of the present invention to provide a system and method which facilitates the ability to carry out a safe launch under emergency conditions.

It is still further object of the present invention to provide a system and method whereby relatively untrained personnel can carry out the necessary steps for the safe launch of a lifeboat.

Is still further object of the present invention to provide a system and method which is easy-to-use, relatively inexpensive, and easy to implement.

These and other objects and advantages of the present invention will become apparent from a reading of the attached specification and appinded claims.

BRIEF SUMMARY OF THE INVENTION

The present invention is a system for directing actions of a helmsman of a lifeboat. The system includes a lifeboat having a connector thereon, a shackle sensor, and a display. The connector is suitable for connection to a shackle of a davit line. The shackle sensor is cooperative with the connector so as to sense when the shackle is engaged are released from the connector. The display is positioned within the lifeboat and is cooperative with the shackle sensor so as to provide the helmsman with a visual indication of the engagement release of the shackle from the connector.

Each of the connectors as a hook pivotally mounted thereto. The hook is movable between an open position allowing the shackle to be engaged with the connector and a closed position retaining the shackle within the connector. A hook sensor is cooperative with the hook so as to sense whether the hook is in the open position or the closed position. The display is cooperative with the hook sensor so as to indicate to the helmsman whether the hook is in the open or closed position.

The connector has a slot formed therein. The slot is suitable for receiving a maintenance pendant pin therein. The connector further includes a maintenance pendant pin sensor positioned adjacent to the slot so as to determine whether a maintenance pendant pin is received within the slot. The display is cooperative with the maintenance pendant pin sensor so as to provide the helmsman with an indication of whether the maintenance pendant pin is positioned in the slot.

In the present invention, the connector can include a first connector positioned at one end of the lifeboat and a second connector positioned at an opposite end of the lifeboat. As such, separate davit lines can be attached to each of the first connector and the second connector.

The lifeboat of the present invention includes a first water sensor affixed to the lifeboat. The first water sensor is suitable for sensing when the lifeboat contacts the surface of the body of water. A second water sensor is also affixed to lifeboat. The second water sensor is also suitable for sensing when the lifeboat is positioned on the body of water. Each of the first and second water sensors is cooperative at the display so as to provide an indication to the helmsman that the lifeboat is positioned in the body of water. In the preferred embodiment the present invention, the first water sensor and the second water sensor are different types of sensors. For example, the first water sensor can be a hydrosensor and the second water sensor can be a proximity sensor.

The lifeboat has a control lever on a control panel. The control lever has a connector engagement position and a connector release position. A first control lever sensor is positioned on the control panel adjacent to the control lever so as to sense when the control lever is in the connector engagement position. A second control lever sensor is positioned on the control panel adjacent to the control lever so as to sense when the control lever is in the connector release position. The lifeboat also has a position locking pin that is slidably engageable with a housing. The control lever is pivotable within the housing. The position locking pin is engaged with the housing so as to prevent a movement of the control lever between the connector engagement position and the connector release position. A position locking pin sensor is positioned in the housing. The position locking pin sensor is suitable for sensing whether the position locking pin is engaged within the housing.

In the present invention, the display provides a sequence of operations on a visual display to the helmsman. A processor is cooperative between the shackle sensor in the display. The processor is suitable for preventing a progression to another operation if a previous operation has not been executed.

The present invention is also a process for providing instruction information to a helmsman during a use of a lifeboat. This process included the steps of: (1) actuating the display within the lifeboat; (2) sensing by at least one of the sensors whether the shackle of a davit line is engaged with the connector of the lifeboat; (3) displaying on the display that the shackle is engaged with the connector; (4) lowering the lifeboat by the davit line toward a surface of the body of water; (5) sensing whether the lifeboat has contacted the surface of the body water; (6) displaying on the display that the lifeboat is positioned on the body of water; and (7) releasing the connector from the shackle such that the lifeboat can move on the body of water.

The process of the present invention further includes the step of providing a signal on the display to the helmsman when the lifeboat is in the water. The signal is indicative of the removal of the locking pin such that the helmsman can move the control lever from its connector engagement position to the connector release position. The connectors of the lifeboat have a slot suitable for the receipt of a maintenance pendant pin therein. The process of the present invention further includes the step of sensing whether the maintenance pendant pin is received in the slot and preventing the step of lowering the lifeboat if the maintenance pendant pin is received in one of the slots. Additionally, the process the present invention further includes the step of preventing the movement of the control lever to the connector release position during the step of lowering. The step of sensing whether the lifeboat has contacted the water includes sensing the contact with the surface of the body of water with a first sensor and sensing the contact with the surface of the body of water with a second sensor. The movement of the control lever to the connector release position is prevented unless the first and second sensors have detected the surface of the body of water.

The lifeboat has a helmsman seat therein. The process of the present invention further includes sensing whether weight has been applied to the helmsman seat, and actuating the display if weight has been sensed as placed on the helmsman seat.

During the recapture of the lifeboat, the following steps are employed: (1) moving the lifeboat toward the shackle of the davit line after the step of moving the lifeboat of the body of water; (2) engaging the shackles with the connector; (3) moving the control lever from the connector release position to the connector engagement position such that the shackle is locked to the connector; and (4) raising the lift line so as to lift the lifeboat from the surface of the body of water.

This foregoing section is intended to describe, with particularity, the preferred embodiment the present invention. It is understood that modifications to this preferred embodiment can be made within the scope of the present invention. As such, the section should not be construed, in any way, as limiting of the broad scope of the present invention. The present invention should only be limited by the following claims and their legal equivalents.

DETAILED DESCRIPTION OF THE INVENTION

Figure 1:
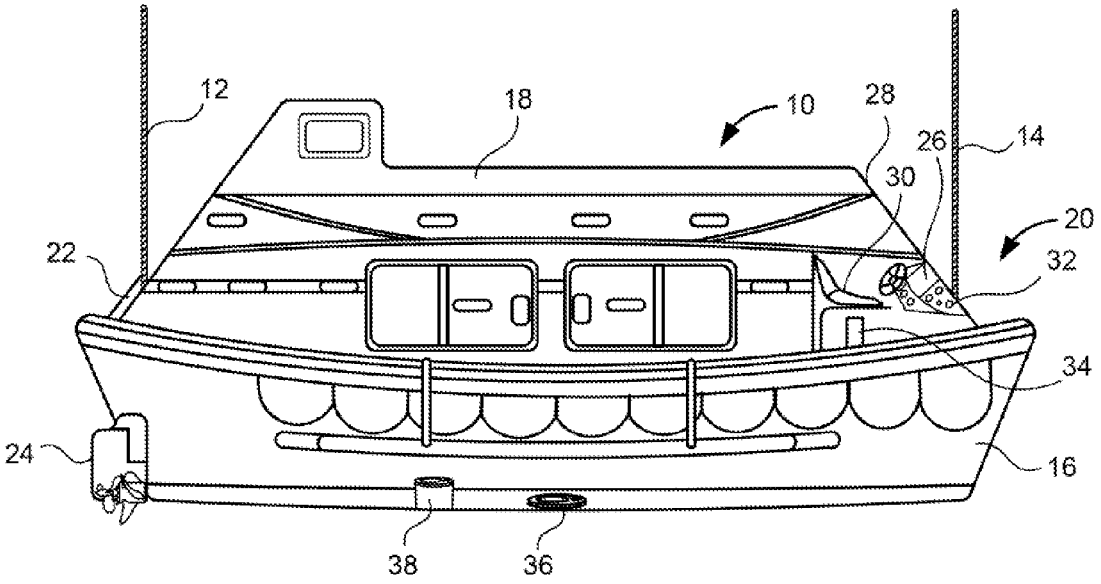
FIG. 1 is a side elevational view showing a lifeboat as connected to davit lines.

Referring to FIG. 1, there is shown a lifeboat 10 that is attached to davit lines 12 and 14. In normal use, the davit lines 12 and 14 will extend from davits associated with a marine vessel, such as a ship or an oil platform. The lifeboat 12 has a body 16 suitable for floating on the body of water. A housing 18 is placed upon the body 16 such that the interior of the lifeboat 10 is enclosed. A first connector 20 is located at one end of the lifeboat 10. A second connector 22 is located at an opposite end of the lifeboat 10. The lifeboat can contain conventional equipment on the interior thereof, such as air supplies, safety equipment, seats, along with other items. Propulsion of the lifeboat 10 can be provided by a motor that can operate a propeller 24.

Figure 4:
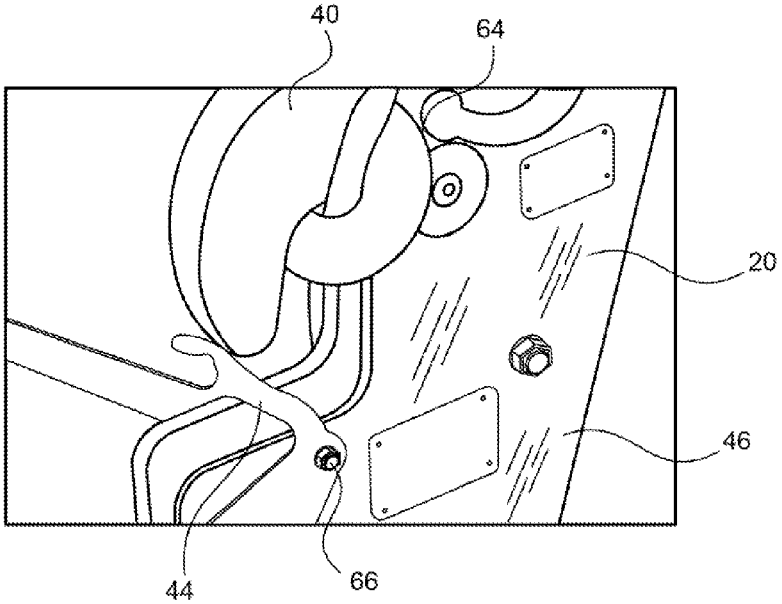
FIG. 4 is a perspective view showing the connector as receiving a shackle therein.

In FIG. 4, in particular, it can be seen that there is a display 26 positioned adjacent the forward end 28 of the housing 18. The display 26 will be located generally or slightly above eye level for the helmsman. A seat 30 is provided on the interior of the lifeboat 10 so as to allow the helmsman to be properly seated for viewing the display 26. A control panel 32 is placed in proximity to the seat 30. The control panel 32, as will be described hereinafter, provides various control mechanism so that the helmsman can properly operate the lifeboat 10.

In FIG. 1, can be seen that there is a sensor 34 positioned under the seat 30. Sensor 34 can be a weight sensor that will detect when the helmsman is seated on the seat 30. When the helmsman is seated on the seat 30, the sensor 34 will activate the display 26. In this situation, the display 26 will display a home screen so that the helmsman can properly select a language for the directions associated with the operation of the lifeboat 10.

The body 16 of the lifeboat 10 includes a first sensor 36 and a second sensor 38 located at the bottom thereof. The sensor 36 will be able to sense whether the body 16 of the lifeboat 10 is in a body of water. Similarly, the second sensor 38 will also be able to sense whether the lifeboat 10 is in the body of the water. The first sensor 38 can be a hydrosensor which relies upon air pressure to determine whether the lifeboat 10 is in the body of water. The second sensor 38 can be in the nature of a proximity sensor. The sensors 36 and 38 are different types of sensors so as to provide redundancy. For example, if one sensor should detect the presence of water while the other sensor does not detect the presence of water, then the control system associated with the present invention will not allow for the release of the davit lines 12 and 14. As such, a single false positive operation will not cause potential risk or improper deployment of the lifeboat 10. If both sensors 36 and 38 should detect the presence of a body of water, then the suitable operations can be carried out so as to release the connectors 20 and 2 from their respective davit lines 14 and 12. The use of a pair of sensors also confirms that the lifeboat 10 is actually in the water, rather than merely located on top of the wave.

Figure 2:
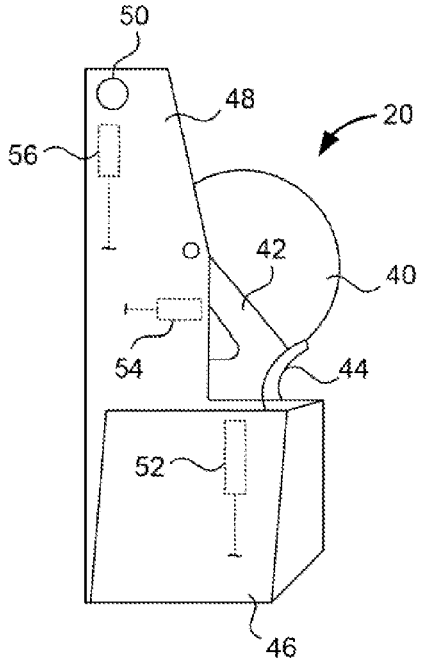
FIG. 2 is a side elevational view showing a connector as used on the lifeboat.

FIG. 2 illustrates the connector 20. Connector 22 will also have a similar configuration. The connector 20 includes a receptacle 40 that has a suitable opening 42 therein. Opening 42 will be suitable for receiving the shackle from the davit line 14. As used herein, the term "shackle" can refer to actual shackles, rings, knots, hooks and similar mechanisms. A hook 44 is provided is pivotally mounted to the body 46 of the connector 20. Hook 44 will be movable between an open position and a closed position. In the open position, the hook 44 is suitable for allowing the shackle to be introduced into the opening 42 for securement within the connector 20. In the closed position (as shown in FIG. 2), the hook 44 will prevent the release of the shackle from the connector 20. The hook 44 is suitable for pivotal movement so as to move between these two positions. The frame 48 of connector 20 includes a slot 50. Slot 50 is suitable for the receipt of a maintenance pendant pin therein. As will be described in connection with FIG. 3, the maintenance pendant pin is intended to provide redundancy for the attachment of the lifeboat 10 during maintenance or inspection procedures.

Importantly, the connector 20 includes a hook sensor 52 that is in the nature of a proximity sensor so as to determine whether the hook 44 is in either its open position or its closed position. A shackle sensor 54 is also provided on connector 20. Shackle sensor 54 will determine whether the shackle is received within the opening 42. The shackle sensor 54 thereby can provide information to the helmsman as to whether the shackle is received within the connector 42 or whether the shackle is released from the connector 20. The maintenance pendant pin sensor 56 is also provided on the connector 20 in proximity to the slot 50. The maintenance pendant pin sensor 56 will determine whether a maintenance pendant pin is located within the slot 50.

Figure 3:
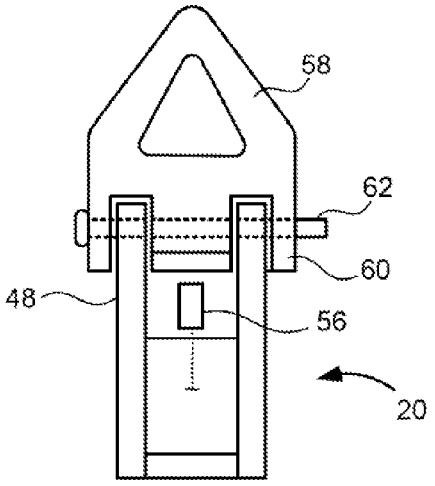
FIG. 3 is an end view showing the connector as attached to a maintenance pendant and a maintenance pendant pin.

In FIG. 3, it is shown that there is a maintenance pendant 58 that is secured to the frame 48 of the connector 20. The maintenance pendant 58 has forked member 60 that are suitably affixed to the frame 48 of the connector 20. A maintenance pendant pin 62 is illustrated as extending between the maintenance pendant 58 and through the slots 50 formed at the top of the frame 48 of the connector 20. The maintenance pendant pin sensor 56 is located in proximity to the maintenance pendant pin 62. As such, the maintenance pendant pin sensor 56 is able to determine whether the maintenance pendant pin 62 is in place or has been removed.

FIG. 8 shows the connector 20 as secured to the shackle 64. It can be seen that the shackle 64 has been received within the slot 42 of the receptacle 40. As such, the shackle sensor 54 will be able to determine that the shackle 64 is properly in place within the connector 20. The hook 44 is illustrated in its closed position so as to provide an prevent the release of the shackle 64 from the opening of the receptacle 40. It can be seen in FIG. 4 that the hook 44 is pivotally attached at 66 to the body 46 of the connector 20.

Figure 5:
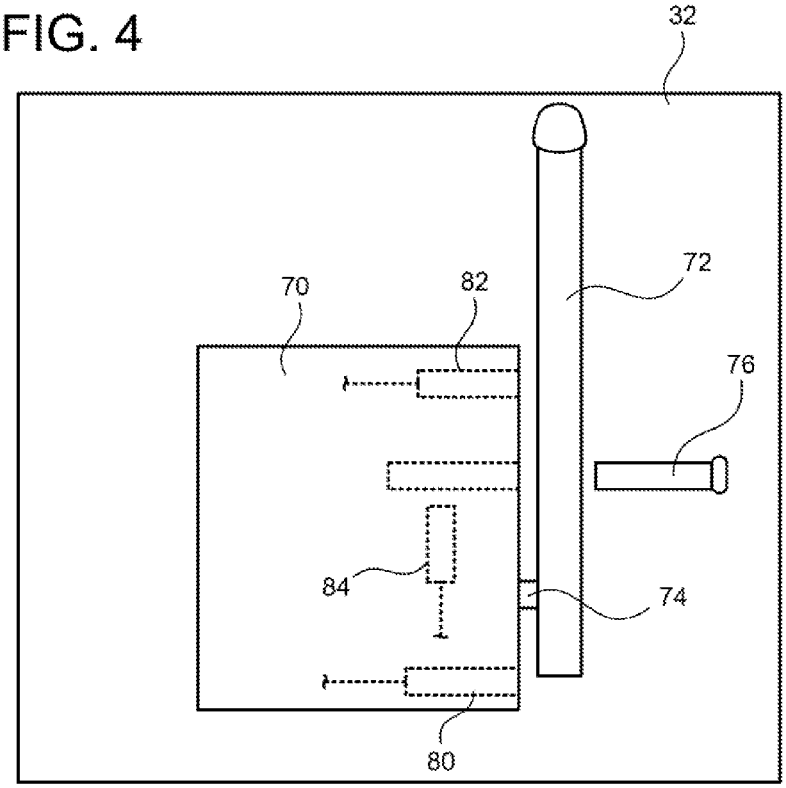
FIG. 5 illustrates a control panel having the control lever mounted to a housing.
Figure 6:
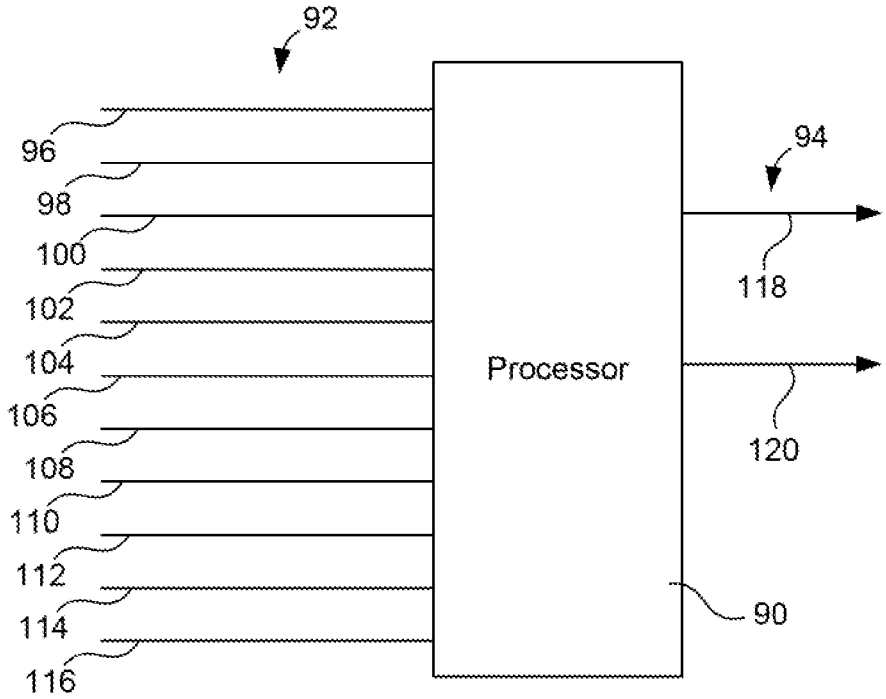
FIG. 6 is a block diagram showing the arrangement of inputs and outputs from a processor.

FIG. 5 illustrates the control panel 32 as positioned for operation by the helmsman. Importantly, there is a housing 70 that is positioned on the control panel 32. The control panel 32 can provide a variety of other indicators, signals, and control mechanisms thereon. Importantly, there is a control lever 72 that is pivotally connected at 74 to the housing 70. A position locking pin 76 is illustrated as in a suitable position for receipt within a slot 78 formed in the housing 70. The position locking pin 76 can be inserted into the slot 74 so as to prevent movement of the control lever 72 between the connector engagement position and the connector release position. FIG. 5 illustrates the control lever 72 in the connector release position. A rotation of the control lever 72 can be suitable so as to move the control lever 72 to the connector engagement position. When the position locking pin 76 is positioned in the slot 78, the position locking pin 76 will prevent the movement of the control lever 72 from connector engagement position to the connector release position.

In FIG. 5, it can be seen that there is a first control lever sensor 80 and a second control lever sensor 82. Sensors 80 and 82 can be in the nature of proximity sensors. When the control lever 72 is moved to its connector engagement position, the sensor 80 will sense the proximity of the control lever 72 so as to provide a signal that control lever 72 is in the connector engagement position. When the control lever 72 moves to the connector release possession, then the sensor 72 will sense the positioning of the control lever 72 in this location. A position locking pin sensor 84 is provided in proximity to the slot 78. As such, the position locking pin sensor 84 will be able to determine whether the position locking pin 76 is received within the slot 78.

In the control and display of the sequence of operations in the present invention, a processor 90 is provided. The processor 90 includes a plurality of inputs 92 and at least a pair of outputs 94. Input 96 will extend to the bow fall prevention pin fully in sensor. Input 98 will be connected to the bow hook in home position sensor. Input 100 is associated with the stowed position jumper connector sensor. Input 102 is cooperative with the hydro sensor. Input 104 is associated with the release handle safety pin sensor. Input 106 is cooperative with the release handle lock position sensor. Input 108 will be cooperative with the release handle release position sensor. Input 110 is cooperative with the stern fall prevention pin fully in sensor. Input 112 will be cooperative at the stern hook-in home position sensor. Input 114 will be cooperative with an oil pressure/engine running sensor. Input 116 is cooperative with the air-pressure hydro sensor. The output 118 will extend to a red light on the display. Output 120 will cooperate with a green light on the display. Various other outputs can be associated with and connected to the processor 90, as required.

Figure 7A:
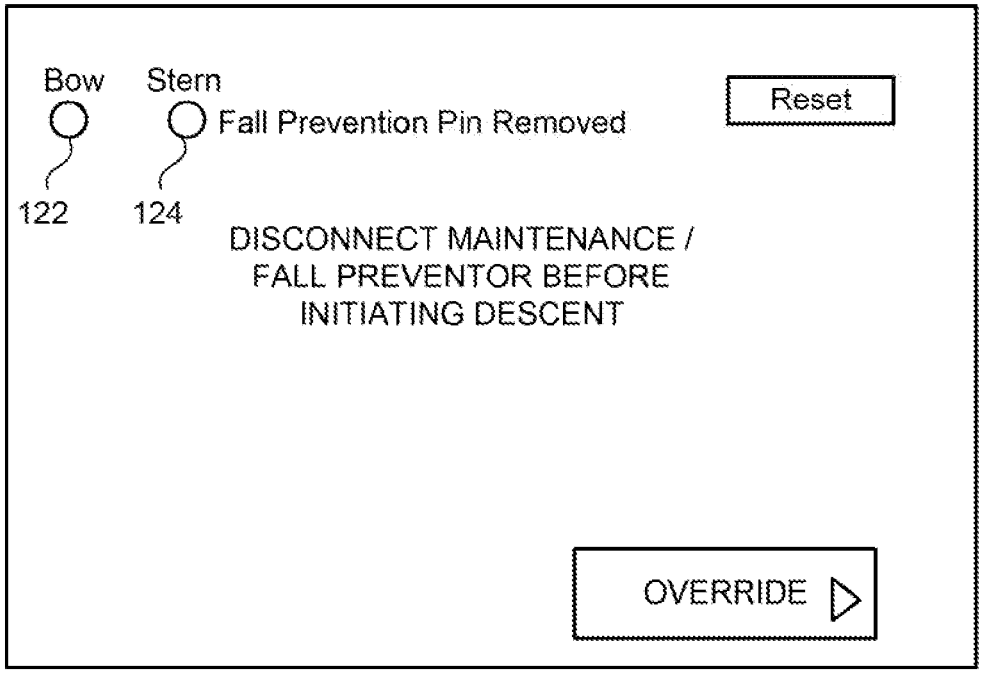
FIGS. 7A-7W show sequentially the displays associated with the deployment and recapture of a lifeboat.
Figure 7B:
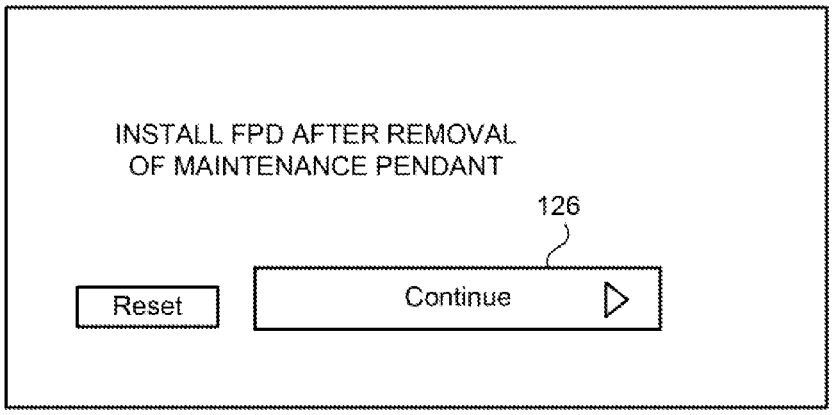
Figure 7C:
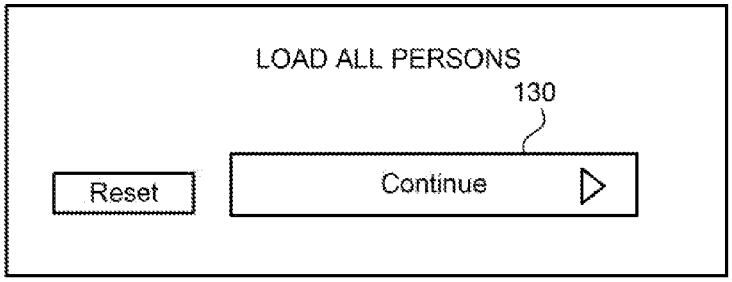
Figure 7D:
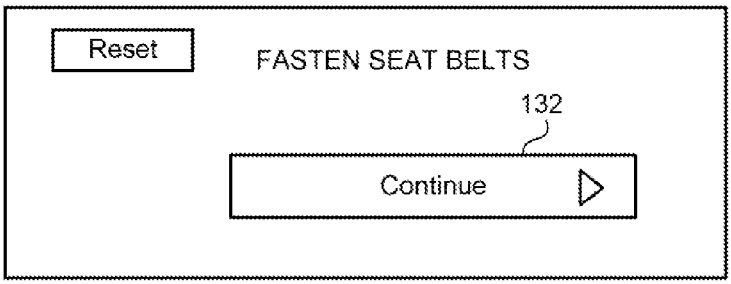
Figure 7E:
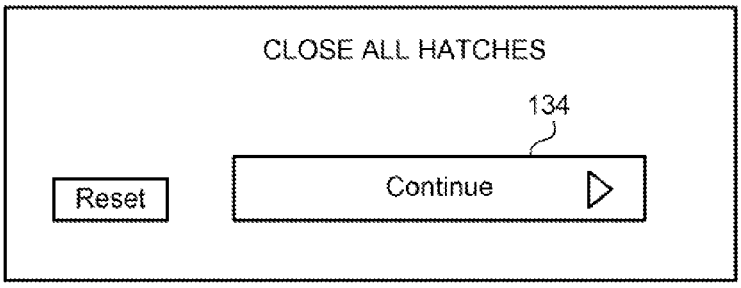
Figure 7F:
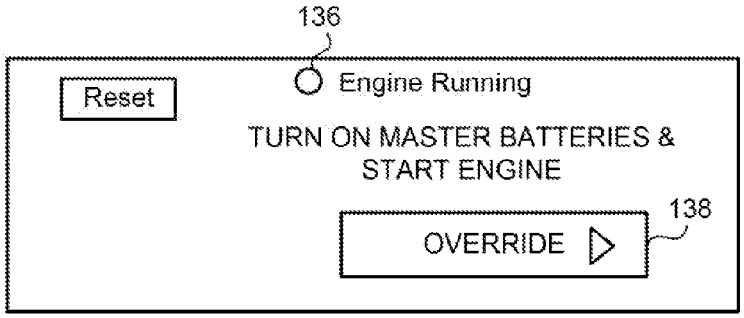
Figure 7G:
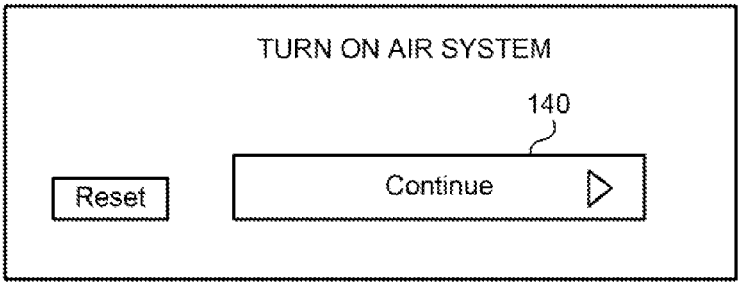
Figure 7H:
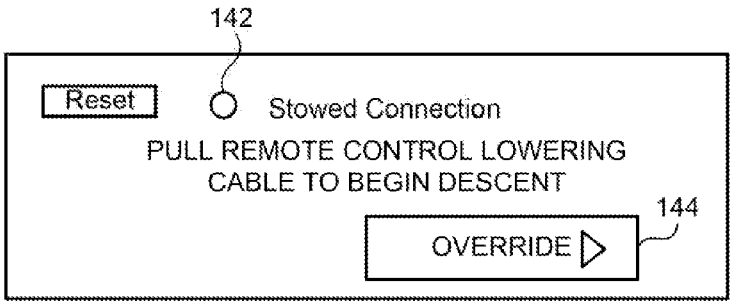
Figure 7I:
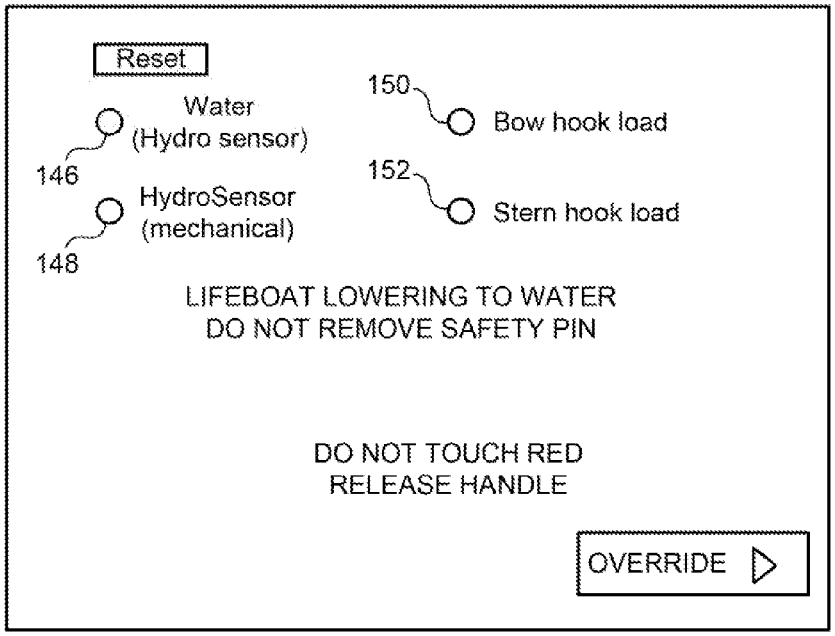
Figure 7J:
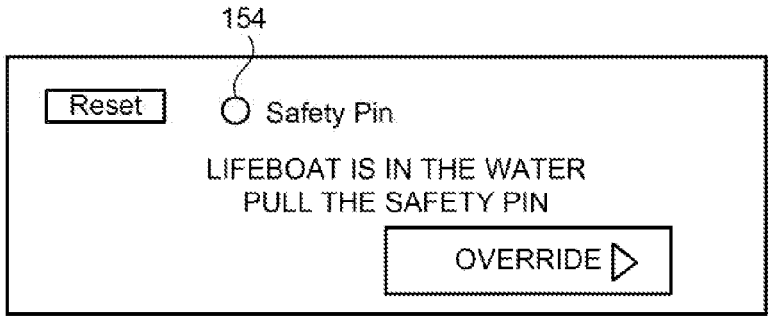
Figure 7K:
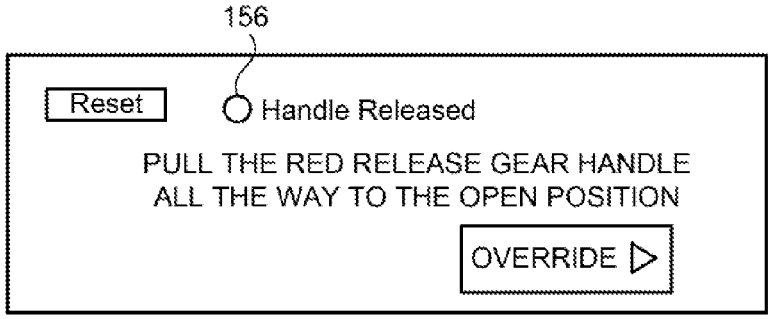
Figure 7L:
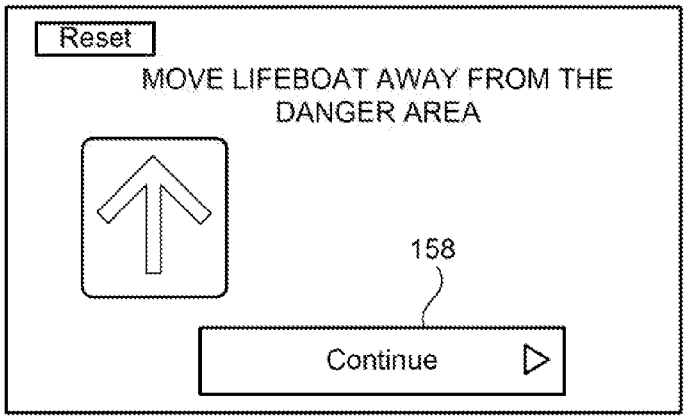
Figure 7M:
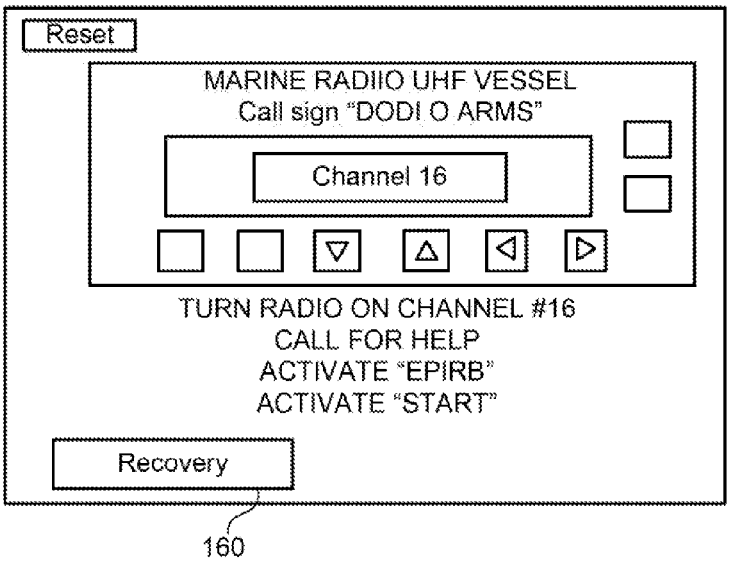
Figure 7N:
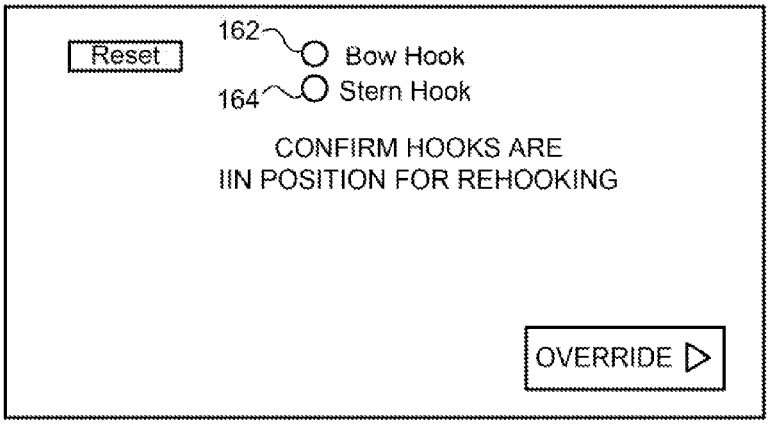
Figure 7O:
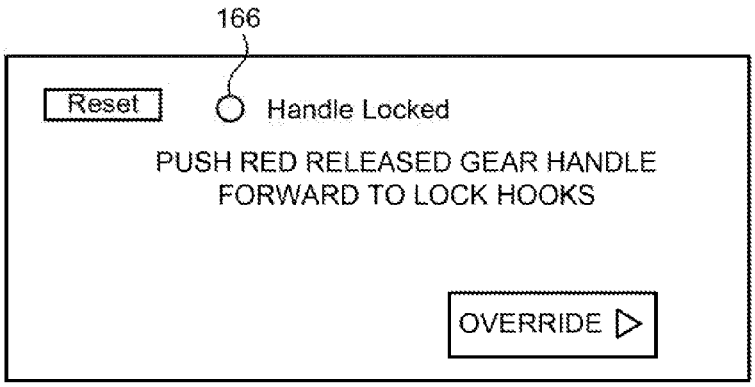
Figure 7P:
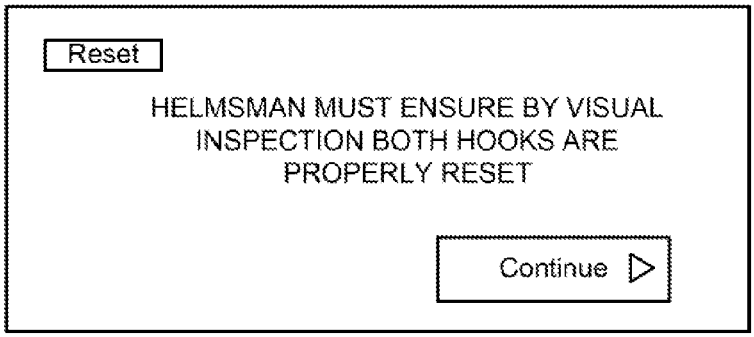
Figure 7Q:
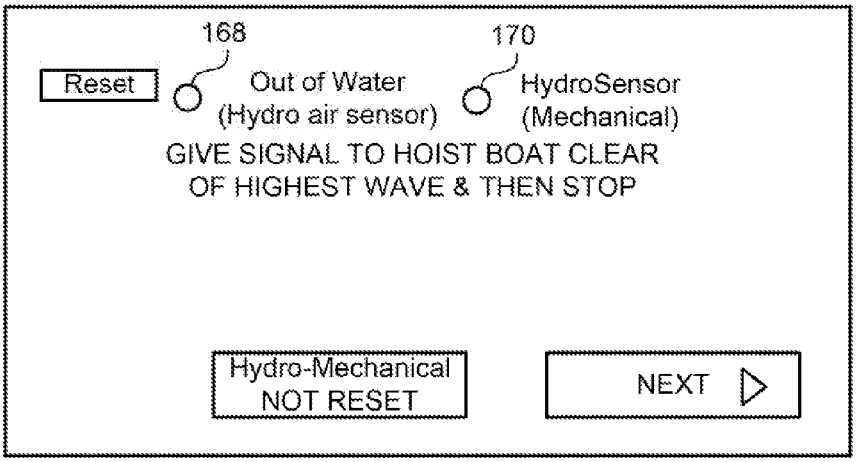
Figure 7R:
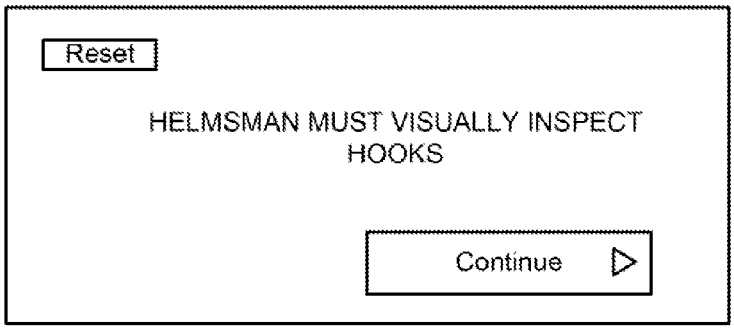
Figure 7S:
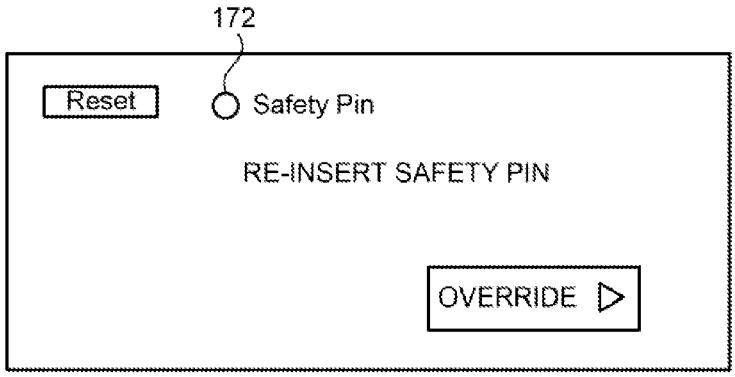
Figure 7T:
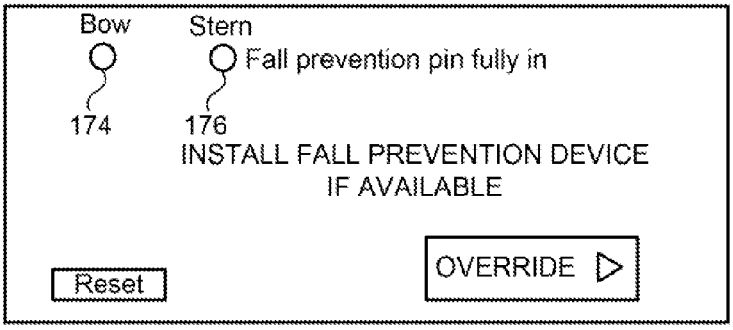
Figure 7U:
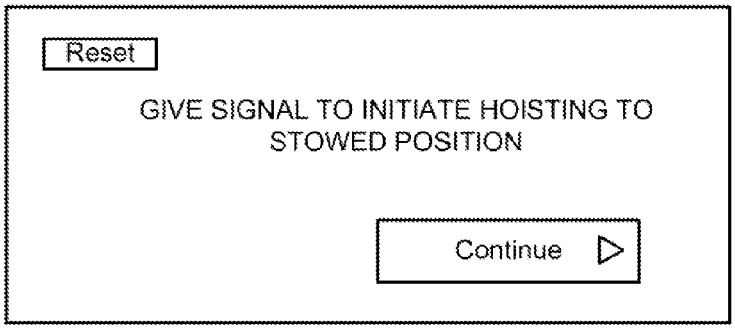
Figure 7V:
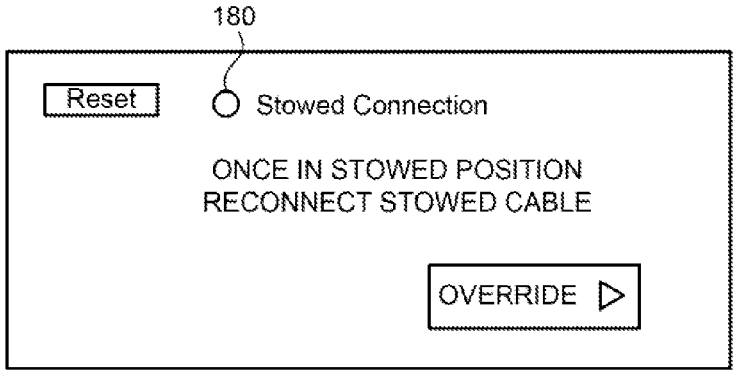
Figure 7W:
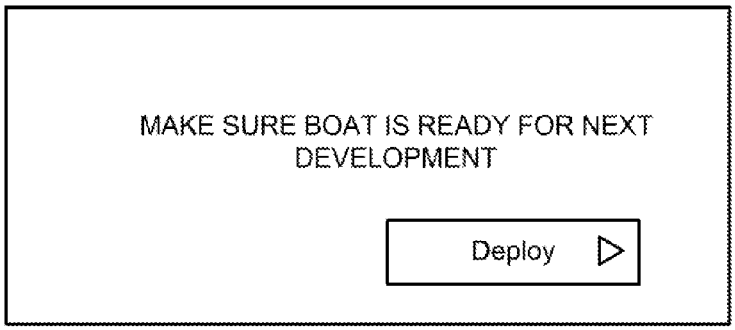

FIGS. 7A-7W illustrate the various displays that are shown on the display for the instructions to the helmsman. The display shown in FIG. 7A is illustrative of the fact that the maintenance pendant pin has been removed. As such, the light 122 associated with the bow maintenance pendant pin and the light 124 associated with the stern maintenance pendant pin will be illuminated green so as to be indicative that the maintenance pendant pin has been removed. If the lights 122 and 124 are green, then subsequent procedures can occur. If one of the lights 122 and 124 should be red, then the system of the present invention will prevent the subsequent procedures. As a result, it will be necessary for an operator or other personnel to take the necessary steps so as to remove the maintenance pendant pins.

FIG. 7B indicates that the fall prevention device should be installed after the removal of the maintenance pendant pin. When the fall prevention device has been installed, the "continue" icon 126 can be pressed so as to proceed to the next operation.

FIG. 7C provides a display to the operator to load persons on to the lifeboat. When the display 7C appears, the fall prevention device has been installed and the maintenance pendant pins have been removed. Unless these steps shown in FIGS. 7A and 7B have been carried out, the display of FIG. 7C will not occur. As such, personnel will not be loaded until such time as the necessary preliminary steps have occurred. The continue button 130 can then be pressed to it is to go to the this screen shown in FIG. 7D.

FIG. 7D indicates to the helmsman that persons onboard the lifeboat should fasten their seatbelts. After the helmsman has notified persons in the lifeboat to fasten their seatbelts, the continue button 132 can be pressed so as to go to the next step. Step 7E provides information to the helmsman to notify persons within the lifeboat to close all hatches. Once the helmsman notes that the hatches have been closed, the continue button 134 can be pressed so as to move to the next step.

FIG. 7F displays the status of the engine. Typically, the operation of the engine will be determined by the oil pressure sensor. A light 136 can be illuminated either green or red. If the light 136 is red, then the step shown in FIG. 7 to turn on master batteries and start engine should occur. Once the engine is started, then the light 136 will be illuminated green. As such, the next step can be carried out. In certain circumstances, the helmsman may choose not to start the engine. As such, the override button 138 can be pressed so as to move to the next stage.

FIG. 7F provides a display to the helmsman to turn on the air system of the lifeboat. Once the air system is turned on, the continue button 140 can be pressed so as to move to the stage shown in FIG. 7H.

FIG. 7H shows a light 142 that is indicative of the stowed connection sensor. If the stowed connection sensor is illuminated green, then the helmsman will be informed to pull the remote control lowering cable so as to begin the descent of the lifeboat. The light 142 will be illuminated green under those circumstances where the maintenance pendant pin has been removed. As such, the accidental lowering of the lifeboat under those circumstances where the maintenance pendant pin remains in place is avoided. An override button 144 is provided so as to allow the helmsman to over ride the step, if the helmsman should determined that the step is not necessary.

FIG. 7I includes a plurality of lights 146, 148, 150 and 152. Each of these lights can be illuminated either red or green. In the step shown in FIG. 7I, the lifeboat is lowered to the water. The bow and stern hook load sensors 150 and 152 associated with the shackle sensors are illuminated green when the shackle sensors senses that the shackles are in place. The two water sensors 146 and 148 will be illuminated red until such time as the lifeboat contacts the water. Importantly, FIG. 7I provides information to the operator to avoid removing the safety pin (otherwise known as the position locking pin). As such, it is not possible for the operator to move the control lever from the shackle engagement position to the shackle release position. The screen shown in FIG. 7I further informs the operator not to touch the red-handled control lever.

When the lifeboat reaches the water, then the water sensors 146 and 148 will be illuminated green. As such, FIG. 7J will inform the helmsman that the lifeboat is in the water. There is a light 154 that indicates whether the safety pin (or position locking pin) is in place. The light 154 will be red until such time as the position locking pin is removed. When the lights 146, 148, 150 and 152 are illuminated green, then the operator can pull the safety pin so as to allow for the movement of the control lever from the shackle engagement position to the shackle release position. In other words, once the lifeboat is in the water, then the operator is free to release the connectors of the lifeboat from the davit lines.

When the safety pin is removed, an instruction is provided within the screen shown in FIG. 7K that the operator can pull the control lever to the shackle release position. Light 156 will indicate that the handle has moved to the shackle release position. Once the lifeboat is released from the davit lines, the lifeboat is freely positioned on the water. As such, the screen shown in FIG. 7L is illuminated. It can be seen that the helmsman is informed to move the lifeboat away from the danger area. In FIG. 7L, once the lifeboat is moved away from the danger area, the helmsman can press the continue button 158 so as to proceed to the screen shown in FIG. 7M.

FIG. 7M informs the helmsman to call for help. Information pertaining to the particular marine channel is provided on the screen of FIG. 7M. Additionally, the helmsman can be informed to activate the "EPIRB" and activate the "SART". As such, the screen shown in FIG. 7M provides positive information to the helmsman as to the particular procedures required in order to initiate radio communications.

Eventually, after the emergency condition has ended or after a drill has ended, it will be desired to recover the lifeboat.

As such, the recovery button 160 can be pressed so as to begin the screens which inform the operator of the various procedures that are required in order to carry out the proper and safe recovery of the lifeboat.

FIG. 7N has lights 162 and 164 that are indicative of the status of the hooks associated with the connector. When the hooks are in the closed position, the sensors associated with such hooks will illuminate the lights 162 and 164 as a red color. The operator will then have to take the necessary steps so as to move the hooks to the open position. Once the hooks are in the open position, the lights 162 and 164 will be illuminated green. Once the lights 162 and 164 are of a green color, it is confirmed that the hooks are now in a position for re-hooking the shackles to the connectors. In this position, the receptacles associated with the connectors are in their shackle release position.

FIG. 7O includes a light 166 to indicate that the control lever is in a locked position. FIG. 7O informs the helmsman to push the control lever forward in order to lock the shackles on to the connectors.

Prior to the lifting of the lifeboat by the davit lines, it is important that the helmsman assure that the shackles are properly locked within the connectors. As such, the screen shown in FIG. 7P will inform helmsman to visually inspect that both of the hooks associated with the bow connector in the stern connector are properly reset.

FIG. 7Q includes lights 168 and 170. Lights 168 and 170 are cooperative at the first and second sensors for sensing the contact with the water. Since the lifeboat can be on waves, it is possible that the spaced positioning of the two sensors will sometimes have one green light and one red light. FIG. 7Q provides the helmsman with the information to give the signal to place the boat clear of the highest wave. Once the lifeboat is located clear of the highest wave, the hoisting operation is stopped. At this stage, the helmsman will be required to once again visually inspect the hooks. FIG. 7R illustrates the information provided to the helmsman to carry out this visual inspection.

Since the control lever has now been returned to the shackle engagement position, it is important for the operator to reinsert the safety pin. FIG. 7S will indicate to the helmsman the need to reinsert the safety pin. The position lock pin sensor will be cooperative with a light 172. Once the position lock pin has been reinstalled, the light 172 will become green. As such, the control lever is prevented from returning to the shackle release position during the hoisting of the lifeboat back to its home position on the offshore vessel.

Once the lifeboat is returned to its home position, the shackle sensors will cooperate with the lights 174 and 176 so as to indicate that the fall prevention pin is fully in. If the lights are red, it is indicative that the fall prevention pins have not been installed. If the lights are green, then the helmsman is assured that the fall prevention device is properly installed.

FIG. 7U informs the top of the helmsman to give the signal to the offshore vessel to initiate the hoisting to a stowed position. In this situation, it is assured that the connectors properly engage the shackles. As such, the lifeboat can be lifted from the surface of the body of water.

FIG. 7 is illuminated so as to inform the helmsman to reconnect the stowed cable. The stowed cable light 180 will be illuminated green once the stowed connection is in place.

Finally, once the lifeboat is properly stowed, the screen of FIG. 7W will inform the helmsman to make sure that the lifeboat is ready for the next deployment. Once the required procedures are completed, the helmsman can exit the lifeboat. Once the helmsman removes his or her weight from the weight sensor associated with the helmsman's seat, the display will turn off after a certain period of time.

The system of the present invention provides an orderly approach to the use of a lifeboat. The present invention enhances the safety for the deployment of a lifeboat by assuring that all of the proper steps are carried out in an ordered manner. Steps cannot be bypassed unless emergency condition should dictate. As such, override buttons are provided on certain of the operations so as to allow the helmsman to carry out tasks under unusual circumstances and to bypass steps, if necessary. The system of the present invention, through its fully informative screen approach, allows relatively unskilled personnel to properly deploy the lifeboat. Unsafe conditions that are caused by the retention of the maintenance pendant pin are avoided in the present invention. Additionally, any inadvertent release of the connectors from the shackles before the lifeboat is in the water are effectively avoided through the use of the position locking pin and through the use of the water sensors. Improper placement of the lifeboat on the water (for example at the peak of a wave) is avoided since both of the water sensors, which are spaced at distances from each other, must be illuminated green before the shackles can be released from the connectors. As such, the present invention provides a comprehensive approach so as to improve the safety of deployment and recapture of lifeboats in offshore conditions.

The foregoing disclosure and description of the invention is illustrative and explanatory thereof. Various changes in the details of the illustrated construction or in the steps of the described process can be made within the scope of the present invention without departing from the true spirit of the invention. The present invention should only be limited by the following claims and their legal equivalents.

I claim:

1. A system for directing actions of a helmsman of a lifeboat, the system comprising:

a lifeboat having a connector thereon suitable for connection to a shackle of a davit line;

a shackle sensor cooperative with the connector so as to sense when the shackle is engaged or released from the connector; and a display positioned within said lifeboat and cooperative with said shackle sensor so as to provide the helmsman with a visual indication of engagement or release of the shackle sensor from the connector, said connector having a slot form therein, said slot receiving a maintenance pendant pin therein, the connector further comprising:

a maintenance pendant pin sensor positioned adjacent said slot so as to determine whether a maintenance pendant pin is received within said slot, said display cooperative with said maintenance pendant pin sensor so as to provide the helmsman with an indication of whether the maintenance pendant pin is positioned in said slot.

2. The system of claim 1, said connector having a hook pivotally mounted thereto, said hook movable between an open position allowing the shackle to be engaged with said connector and a closed position retaining said shackle within said connector.

3. The system of claim 2, further comprising:

a hook sensor cooperative with said hook so as to sense whether the hook is in the open position or the closed position, said display cooperative with said hook sensor so as to indicate to the helmsman whether the hook is in the open position or the closed position.

4. The system of claim 1, said connector comprising a first connector positioned at one end of said lifeboat and a second connector positioned at an opposite end of said lifeboat.

5. A system for directing actions of a helmsman of a lifeboat, the system comprising:

a lifeboat having a connector thereon suitable for connection to a shackle of a davit line;

a shackle sensor cooperative with the connector so as to sense when the shackle is engaged or released from the connector; and a display positioned within said lifeboat and cooperative with said shackle sensor so as to provide the helmsman with a visual indication of engagement or release of the shackle sensor from the connector;

a first water sensor affixed said lifeboat, said first water sensor suitable for sensing when said lifeboat contacts a surface of a body of water; and a second water sensor affixed to said lifeboat, said second water sensor suitable for sensing when said lifeboat is positioned on the body of water, each of said first water sensor and said second water sensor being cooperative with said display so as to provide an indication to the helmsman that the lifeboat is positioned in the body of water.

6. The system of claim 5, said first water sensor and said second water sensor being different types of sensors.

7. The system of claim 1 said lifeboat having a control lever on a control panel, said control lever having a connector engagement position and a connector release position, the system further comprising:

a first control lever sensor positioned on said control panel adjacent said control lever so as to sense when said control lever is in said connector engagement position; and a second control lever sensor positioned on said control panel adjacent said control lever so as to sense when said control lever is in said connector release position.

8. The system of claim 7, said lifeboat having a position locking pin slidably engageable with a housing, said control lever pivotable within said housing, said position locking pin engaged with said housing so as to prevent a movement of said control lever between the connector engagement position and the connector release position.

9. The system of claim 8, further comprising:

a position locking pin sensor positioned in said housing, said position locking pin sensor suitable for sensing whether said position locking pin is engaged within said housing.

10. A system for directing actions of a helmsman of a lifeboat, the system comprising:

a lifeboat having a connector thereon suitable for connection to a shackle of a davit line;

a shackle sensor cooperative with the connector so as to sense when the shackle is engaged or released from the connector; and a display positioned within said lifeboat and cooperative with said shackle sensor so as to provide the helmsman with a visual indication of engagement or release of the shackle sensor from the connector, said display providing a sequence of operations as a visual display to the helmsman a processor cooperative between said shackle sensor in said display, said processor suitable for preventing a progression to another operation if a previous operation has not been executed.

11. A process for providing instruction information to a helmsman during a use of a lifeboat, the lifeboat having a plurality of sensors thereon and a display cooperative with the plurality of sensors, the process comprising:

actuating the display within the lifeboat;

sensing by at least one of said plurality of sensors whether a shackle of a davit line is engaged with a connector on the lifeboat;

displaying on the display that the shackle is engaged with the connector;

lowering the lifeboat by the davit line toward a surface of a body of water;

sensing whether the lifeboat has contacted the surface of the body of water;

displaying on the display that the lifeboat is positioned on the body of water; and releasing the connector from the shackle such that the lifeboat can move on the body of water.

12. The process of claim 11, said lifeboat having a control lever movable between a connector engagement position and a connector release position, said lifeboat having a locking pin cooperative with said control lever so as to prevent movement of said control lever between the connector engagement position and the connector release position, the process further comprising:

providing a signal on the display to the helmsman when the lifeboat is in the water, said signal being indicative of the removal of said locking pin such that the helmsman can move the control lever from the connector engagement position to the connector release position.

13. The process of claim 11, the connector of the lifeboat having a slot suitable for the receipt of a maintenance pendant pin therein, the process further comprising:

sensing of whether the maintenance pendant pin is received in the slot; and preventing the step of lowering the lifeboat if the maintenance pendant pin is received in the slot.

14. The process of claim 12, further comprising:

preventing a movement of said control lever to said connector release position during the step of lowering.

15. The process of claim 12, the step of sensing whether the lifeboat has contacted the water comprising:

sensing the contact with the surface of the body of water with a first sensor; and sensing the contact with the surface of the body of water with a second sensor.

16. The process of claim 15, further comprising:

preventing movement of the control lever to the connector release position unless each of said first and second sensors has detected the surface of the body of water.

17. The process of claim 11, the lifeboat having a helmsman seat therein, the method further comprising:

sensing whether weight has been applied to the helmsman seat; and actuating said display if weight has been sensed as placed on the helmsman seat.

18. The process of claim 12, further comprising:

moving the lifeboat toward the shackle of the davit line after the step of moving the lifeboat on the body of water;

engaging the shackle with the connector;

moving the control lever from the connector release position to the connector engagement position such that the shackle is locked to the connector; and raising the lift line so as to lift the lifeboat from the surface of the body of water.

* * * * *